US009089822B2

(12) United States Patent
Nicholson

(10) Patent No.: US 9,089,822 B2
(45) Date of Patent: Jul. 28, 2015

(54) AERATION SYSTEM

(76) Inventor: Hugh B. Nicholson, Tallahassee, FL (US)

( * ) Notice: Subject to any disclaimer, the term of this patent is extended or adjusted under 35 U.S.C. 154(b) by 340 days.

(21) Appl. No.: 13/567,495

(22) Filed: Aug. 6, 2012

(65) Prior Publication Data

US 2013/0032957 A1 Feb. 7, 2013

Related U.S. Application Data

(60) Provisional application No. 61/515,071, filed on Aug. 4, 2011.

(51) Int. Cl.
*B01F 3/04* (2006.01)
*B01F 7/00* (2006.01)

(52) U.S. Cl.
CPC ..... *B01F 7/00733* (2013.01); *B01F 3/04588* (2013.01); *B01F 3/04595* (2013.01)

(58) Field of Classification Search
CPC .... B01F 7/12; B01F 3/04588; B01F 7/00241; B01F 3/04595; B01F 7/00733
USPC ..... 440/38, 66–67; 261/76–77, 83–85, 93; 210/219–220, 221.2
See application file for complete search history.

(56) References Cited

U.S. PATENT DOCUMENTS 1,817,665 A * 8/1931 Bailey ..... 261/84
1,824,737 A * 9/1931 Johnson et al. ..... 440/53
2,438,714 A * 3/1948 McMillan ..... 261/84
2,657,025 A * 10/1953 Henrard ..... 261/84
2,802,647 A * 8/1957 Bolton ..... 366/263
2,918,009 A * 12/1959 Crevoisier ..... 418/15
3,476,070 A * 11/1969 Austen ..... 440/88 R
3,844,897 A * 10/1974 Mueller ..... 435/298.1
3,932,567 A * 1/1976 Skidmore ..... 261/30
3,976,453 A * 8/1976 Brown ..... 96/239
4,193,950 A * 3/1980 Stockner et al. ..... 261/87

(Continued)

FOREIGN PATENT DOCUMENTS

CN 1403704 A * 3/2003
CN 2646040 Y 10/2004

(Continued)

OTHER PUBLICATIONS

Google translation of CN 1403704 A.*

(Continued)

*Primary Examiner* — Duane Smith
*Assistant Examiner* — Stephen Hobson
(74) *Attorney, Agent, or Firm* — Maier & Maier, PLLC

(57) ABSTRACT

An aeration system including a housing, a fluid inlet at a first end of the housing, an outlet at a second end of the housing, a cylindrical support member rotatably mounted within the housing between the inlet and the outlet, and supported by a plurality of bearings, the support member having an interior surface enclosing an interior cavity, the cavity being in communication with the inlet and the outlet, at least one vane disposed on the interior surface of the support member and extending from the interior surface towards the rotational axis of the support member, the vane including an inner edge positioned such that a gap is defined between the inner edge of the vane and the rotational axis of the support member, at least one gas inlet in communication with the cavity of the support member, and a motive device for rotating the support member within the housing.

18 Claims, 8 Drawing Sheets

(56) References Cited

U.S. PATENT DOCUMENTS

| | | | | | |
|---|---|---|---|---|---|
| 4,710,325 | A | * | 12/1987 | Cramer et al. | 261/24 |
| 4,838,819 | A | | 6/1989 | Todorovic | |
| 4,931,026 | A | * | 6/1990 | Woodland | 440/38 |
| 5,046,975 | A | * | 9/1991 | Buzzi | 440/66 |
| 5,222,863 | A | | 6/1993 | Jones | |
| 5,383,802 | A | * | 1/1995 | Nicholson | 440/38 |
| 5,928,042 | A | * | 7/1999 | Quiggins | 440/72 |
| 6,126,361 | A | * | 10/2000 | Gardiner | 405/53 |
| 6,135,831 | A | * | 10/2000 | Lanni et al. | 440/49 |
| 6,159,060 | A | * | 12/2000 | Purnell et al. | 440/46 |
| 6,325,842 | B1 | * | 12/2001 | Caldwell et al. | 95/263 |
| 6,328,289 | B1 | * | 12/2001 | Becchi | 261/84 |
| 7,371,139 | B1 | * | 5/2008 | Abella | 440/67 |
| 2003/0186601 | A1 | * | 10/2003 | Collier et al. | 440/66 |
| 2005/0263914 | A1 | | 12/2005 | Kojima | |
| 2005/0280167 | A1 | | 12/2005 | Hills | |
| 2006/0166570 | A1 | * | 7/2006 | Norman | 440/66 |
| 2007/0270056 | A1 | | 11/2007 | Abdel-Maksoud et al. | |
| 2008/0296788 | A1 | | 12/2008 | Rho et al. | |
| 2009/0127724 | A1 | * | 5/2009 | Tsai | 261/64.1 |
| 2011/0263168 | A1 | * | 10/2011 | Adams | 440/67 |
| 2012/0187587 | A1 | * | 7/2012 | Hills | 261/93 |
| 2013/0059491 | A1 | * | 3/2013 | Lehmann et al. | 440/66 |

FOREIGN PATENT DOCUMENTS

| | | | | |
|---|---|---|---|---|
| CN | 1655984 | A | | 8/2005 |
| FR | 2 453 669 | | * | 11/1980 |
| JP | 59069194 | A | * | 4/1984 |
| JP | 61203000 | A | * | 9/1986 |
| JP | 62289296 | A | * | 12/1987 |
| WO | 2005089920 | A1 | | 9/2005 |
| WO | 2005/092702 | A1 | | 10/2005 |
| WO | 2007005209 | | | 1/2007 |
| WO | WO 2009088356 | A1 | * | 7/2009 |
| WO | 2011073717 | A1 | | 6/2011 |

OTHER PUBLICATIONS

The International Search Report for corresponding PCT Application No. PCT/US2008/003627 dated Sep. 22, 2008.

The first Office Action, dated Jun. 21, 2012, and English translation thereof in corresponding Chinese Application No. 2008801259980. pp. 15 (including english translation).

International Search Report and Written Opinion dated Nov. 23, 2012, as issued in the corresponding International Patent Application No. PCT/US/2012/049732, filed Aug. 6, 2012.

* cited by examiner

AERATION SYSTEM

CROSS-REFERENCE TO RELATED APPLICATIONS

This application claims priority to U.S. Provisional Patent Application No. 61/515,071, filed Aug. 4, 2011, and entitled AERATION AND ASPIRATION SYSTEM FOR OXYGENATION OR OTHER GAS INTRODUCTION TO A FLUID MEDIUM, the entire contents of which are hereby incorporated by reference.

BACKGROUND

In some conventional aeration systems, gas is compressed and pumped into tubes or diffusion devices for introduction into a fluid medium. In other conventional aeration systems, water is sprayed through gas to allow gas transfer before returning to a body of fluid to be aerated. These systems require large expenditures of mechanical energy, and further produce a localized or confined area of aeration. Such aeration areas then rapidly return to the surface of the fluid medium, or are confined to the momentary exposure to gas before contact with the fluid medium surface. Yet other aeration systems allow for gas to be entrained in an existing flow of fluid medium, but are limited to low efficiency pumps and are subject to fouling if used in high-particulate environments such as wastewater or sewage treatment plants.

Since efficient aeration of a fluid medium is a product of the surface diffusion interface between the interior of gas bubbles and the fluid medium, it is advantageous to increase this gas transfer potential by decreasing the relative size of gas bubbles and increasing their relative density. Since this process continues over time, it is also advantageous to keep introduced gas bubbles from reaching the surface of the fluid medium to the effect that a given quantity of gas is largely stripped of oxygen by the time it exits the fluid medium. It is also known that cooler water can contain a larger percentage of dissolved oxygen than warmer water, so there is an additional advantage to any cooling or refrigeration of the fluid-gas interface during the diffusion process.

An aeration system that can achieve a high rate of aeration while minimizing the disadvantages of conventional aeration systems is therefore desired.

SUMMARY

According to at least one exemplary embodiment, an aeration system is disclosed. The aeration system can include a housing, a fluid inlet disposed at a first end of the housing, an outlet disposed at a second end of the housing, a cylindrical support member rotatably mounted within the housing between the inlet and the outlet, and supported therein by a plurality of bearings, the support member having an interior surface enclosing an interior cavity, the interior cavity being in communication with the fluid inlet and the outlet, at least one vane disposed on the interior surface of the support member and extending from the interior surface towards the rotational axis of the support member, the vane including an inner edge positioned such that a gap is defined between the inner edge of the vane and the rotational axis of the support member, at least one gas inlet in communication with the interior cavity of the support member, and a motive device for rotating the support member within the housing.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1A:
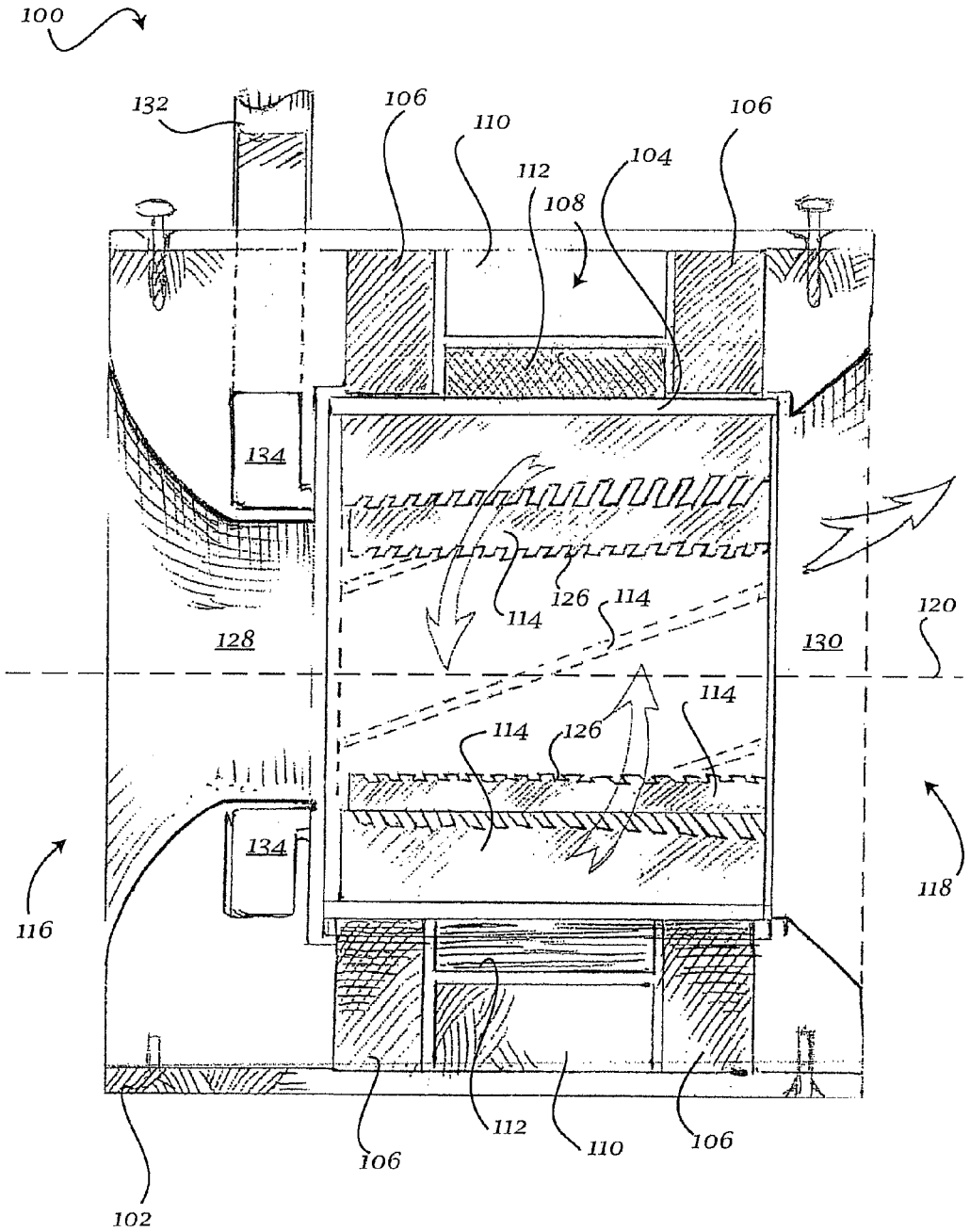
FIG. 1A is a longitudinal section view of an exemplary embodiment of an aeration system.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, an aeration system is disclosed. Embodiments of the aeration system disclosed herein may be operable to oxygenate, or introduce any desired gas into a fluid medium. The system can achieve a high rate of oxygenation by: increasing available diffusion interfaces; increasing the relative density of gas bubbles in the fluid medium; maintaining the diffusion interfaces in contact with the fluid medium for prolonged periods of time; introducing aerated streams to discrete areas of the fluid medium or homogenous mixing of large volumes or areas of the fluid medium; and effecting a reduction of temperature in the areas area of initial gas introduction. As used herein, the term "gas" should be understood as including any vapor or gaseous-state matter having any desired composition, including atmospheric air, pure gas, or a mixture of gases.

Embodiments of the aeration system disclosed herein may further utilize internal shear forces that are generated between dissimilar velocities of adjacent fluid streams, as well as volumetric differences between adjacent fluid streams to generate low pressure areas in the fluid. The system may include at least one rotatable vane. The low pressure areas may be formed proximate the edge of the at least one vane of the aeration system when the vane is rotated. The low pressure areas can further draw gas into the system at atmospheric pressure. Other embodiments of the aeration system disclosed herein may utilize conduits, for example ducts, tubes or ports, to introduce gas into the into the low pressure areas.

Embodiments of the aeration system disclosed herein may further utilize variable controls and venturi effects to reduce or expand the volume of gas admitted to the system.

Embodiments of the aeration system disclosed herein may further utilize a vortex or whirlpool to draw in gas from a surface of a fluid medium. The gas may be drawn through a swirl-induced tube of fluid into the low pressure areas within the aeration system.

Embodiments of the aeration system disclosed herein may further utilize irregularities or serrations on the edge of the at least one vane so as to augment mixing and fragmentation of the entrained gas stream in order to produce a multiplicity of small gas bubbles ("microbubbles").

Embodiments of the aeration system disclosed herein may further introduce vibrations to the gas and fluid stream so as to create sound waves capable of further reduction of bubble size and a corresponding increase in available diffusion areas.

Embodiments of the aeration system disclosed herein may further utilize the expansion of gas (whether introduced into the fluid or spontaneously vaporized within the fluid) in the low pressure regions of the system so as to reduce the temperature of the fluid and the bubble stream in order to augment gas or gas saturation in the fluid medium.

Embodiments of the aeration system disclosed herein may further utilize the thrust created by the above effects in order to vector or direct the mixed flow stream exiting the system to discrete locations in the fluid medium.

Embodiments of the aeration system disclosed herein may further utilize a mixed flow stream to augment homogeneity of the surrounding fluid by mixing or circulating a fluid in a tank or other body of fluid medium, in proximity to or in contact with the system.

Embodiments of the aeration system disclosed herein may further be attached to a fluid delivery conduit, or placed within an existing fluid delivery conduit so as to accelerate and/or aerate the fluid. In some exemplary embodiments, the system can act as a fluid pump within a conduit or between conduits. In embodiments where suction regions generated within the system reduce pressures within the conduit below ambient pressures surrounding the conduit and below conduit inlet pressures, gas may be entrained within the contained fluid flow. In such embodiments, a one-way valve may be provided to allow air to move from the external higher-pressure areas to the internal lower-pressure areas. When internal pressures exceed ambient external pressures, the one-way valve may restrict air from moving from internal higher-pressure areas to external lower-pressure areas.

Embodiments of the aeration system disclosed herein may constrict the diameter of the exiting fluid flow so as to increase the concentration of the entrained gas bubbles, thereby facilitating increased effectiveness of transit through the surrounding fluid medium. Embodiments of the aeration system disclosed herein may further utilize fixed planes mounted in the fluid exit flow and parallel to the axis of rotation of the at least vane so as to direct the fluid flow in a rearward, rather than a radial direction.

Embodiments of the aeration system disclosed herein may further be manufactured so as to be compact, portable, resistant to chemical corrosion, resistant to abrasion, operable while fully immersed in a fluid, and including remote control capabilities. Embodiments of the aeration system disclosed herein may further be operable with reduced energy consumption and reduced maintenance requirements in comparison with conventional aeration systems.

Referring generally to FIGS. 1*a*-3, exemplary embodiments of an aeration system may be disclosed. The aeration system can include a housing, the housing supporting a rotating vane support member having at least one vane extending towards but not reaching the axis of rotation of the support member. A plurality of bearings may be disposed between the housing and the vane support member, such as, but not limited to, sleeve bearings, water- or oil-lubricated bearings, ball bearings, and the like. The bearings may be formed from any suitable material that enables the system to function as described herein, for example, but not limited to, metal, graphite, plastic, ceramic, or the like. The system may further include seals for isolating the bearings from the fluid medium. The vane support member and associated at least one vane may be powered by any known motive device, including, but not limited to, chain drives, belt pulleys, gears, electric motors, shafts, and the like. The aeration system can further include an inlet area defining a path for introducing fluid and gas into the system. The at least one vane can further include slots, serrations, depressions or similar structures on the inside edge thereof. In some embodiments, the aeration system can further include at least one conduit for introduction of gas, such as, but not limited to, a duct, a cavity, a tube, or the like. In some embodiments, the aeration system can further include structures for attaching the front and rear portions of the aeration system to a fluid delivery conduit. In some embodiments, the aeration system can further include inlet fins for facilitating the straightening of intake fluid flow, and can further include supporting conduits for directing gas from the surface of the fluid medium to the front portion of the device. In some embodiments, the trailing edge of the inlet fins can impinge closely on the leading edge of the internal conduit rotating vanes so as to provide a shearing or cutting effect that can clip or shear off any filamentous or other materials that are directed towards the rotating blades or entrained in the intake fluid flow.

Figure 1B:
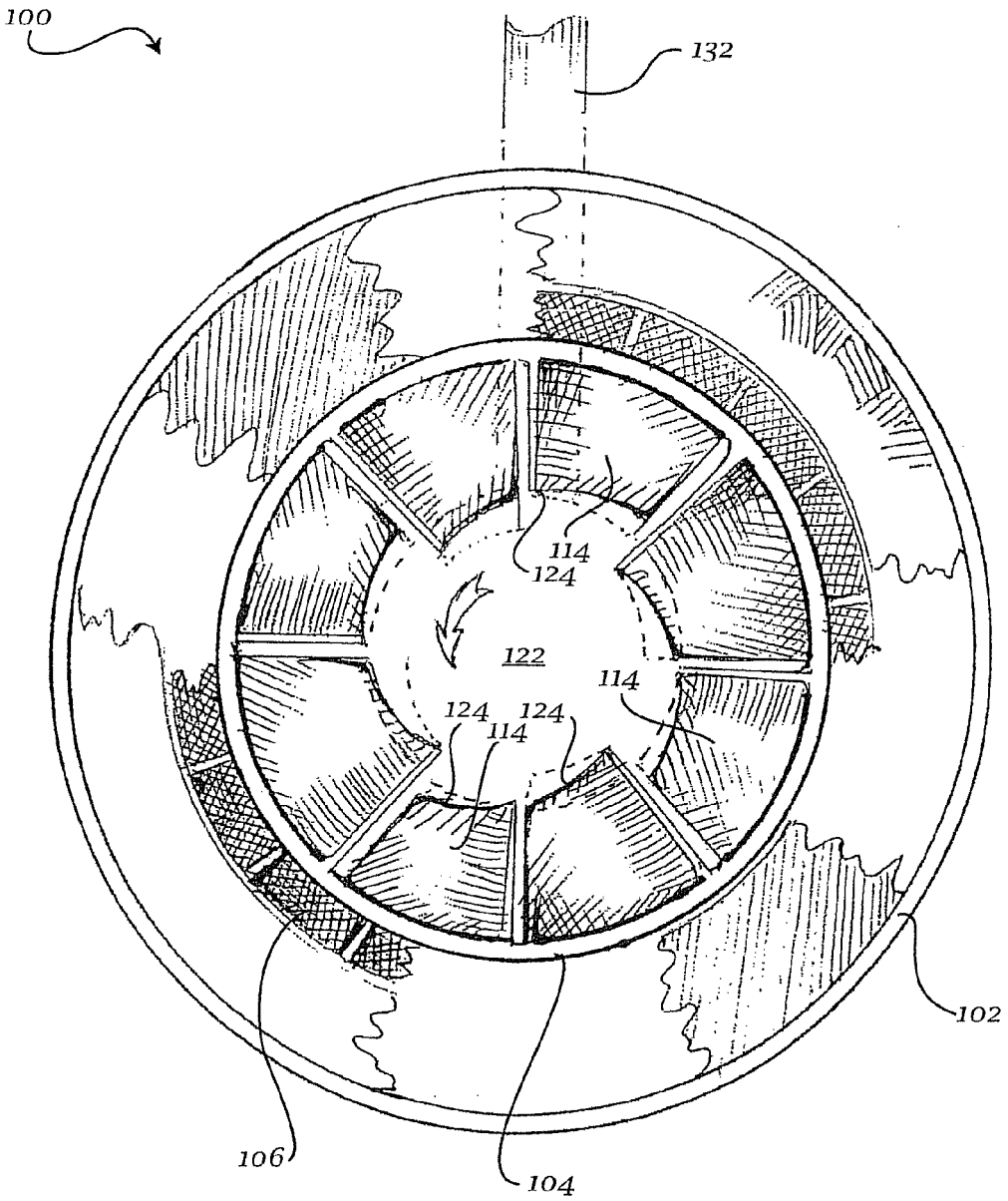
FIG. 1B is a cross-section view of an exemplary embodiment of an aeration system.

FIGS. 1A-1B shows an exemplary embodiment of an aeration system 100. The aeration system 100 includes a housing 102, which may have a substantially cylindrical configuration. Disposed within housing 102 may be a rotating vane support member 104, which may also have a substantially cylindrical configuration. Vane support member 104 may be held in position by a plurality of bearings 106 disposed between housing 102 and vane support member 104. Bearings 106 can allow for the rotation of vane support member 104 within housing 102. Bearings 106 may include any known bearing that allows system 100 to function as described herein, for example, ball bearings, sleeve bearings, and the like, and may be formed from any suitable material, for example metal, plastic, graphite or the like. Bearings 106 may further be lubricated with oil, water or graphite-based materials and may include hydroplaning surfaces.

A motive device, for example an electric motor 108, may be operable to rotate vane support member 104 within housing 102, along an axis of rotation 120 that may be substantially parallel to the longitudinal axis of housing 102. In some exemplary embodiments, electric motor 108 may be configured to include a stator 110 fixedly coupled to housing 102 and a rotor 112 coupled to vane support member 104. In other exemplary embodiments, any other motive devices that enable system 100 to function as described herein may be utilized.

Vanes 114 may be disposed on the interior surface of vane support member 104. The number of vanes 114 may vary depending on the particular design considerations. Vanes 114 may extend substantially longitudinally along support member 104 so as to allow and generate a flow of fluid from the front 116 of system 100 to the rear 118 of system 100. To that end, vanes 114 may be mounted at an angle to the axis of rotation that enables the above-described fluid flow, for example in a diagonal or spiral configuration. The angle of attack of vanes 114 may be varied as desired based on the particular design considerations. Furthermore, vanes 114 may extend inwardly from the interior surface of support member 104 towards axis of rotation 120, yet not extending fully towards axis of rotation 120. Thus, vanes 114 can define a bore 122 arranged concentrically with axis of rotation 120. Bore 122 can facilitate the flow of fluid from the front 116 of system 100 towards the rear 118 of system 100 and can further provide a passageway for any contaminants or particulate matter in the fluid such that the particulate matter does not interfere with the operation of system 100. The extent of each vane 114 towards axis 120 can be varied as desired based on the particular design considerations.

Figure 1C:
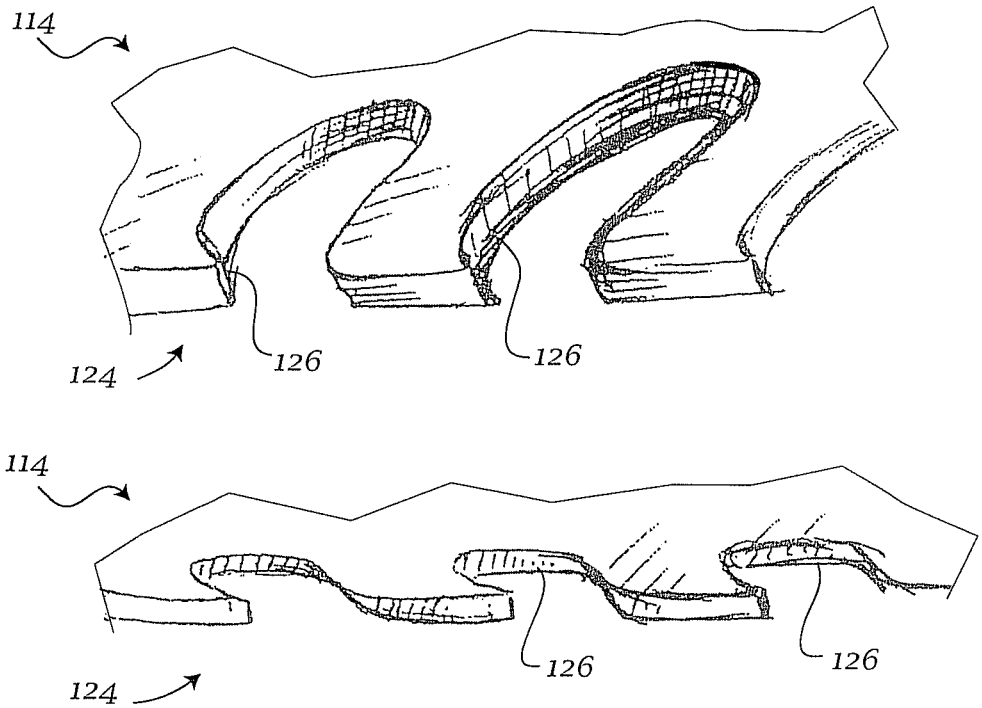
FIG. 1C is a partial view of exemplary blade serrations for an aeration system.

The inner longitudinal edge 124 of each vane 114 may be smooth or may include a plurality of serrations, undulations, indentations, or other irregularities 126 defined therein. Serrations 126 can impinge upon discrete regions of the axial flow of fluid. Serrations 126 can thereby facilitate creating low pressure gradients at multiple locations along the fluid travel path across edge 124. The specific shapes of serrations 126 can be adapted to produce vibrations, which may be sonic vibrations, that can disrupt larger gas bubbles entrained in the fluid flow, thereby facilitating the creation of smaller bubbles and increasing the cumulative gas bubble surface area and diffusion area. Non-limiting examples of such serrations 126 are shown in FIG. 1C.

A fluid inlet 128 may be disposed at the front 116 of system 100. Inlet 128 may have any desired cross-section. In some exemplary embodiments, as shown in FIG. 1A, inlet 128 may have a cross section having its widest diameter proximate front 116, with the cross-section narrowing as it approaches support member 104. Furthermore, the surface of the narrowing portion of inlet 128 may be substantially curved. Fluid and any gas entrained therein may be received through inlet 128 and impelled therethrough by the force of rotating vanes 114, for example by centrifugal force and Archimedes screw effects. Inlet 128 can further allow for introduction of vortex-introduced gas which has been entrained from the surface. This gas may be sucked into the low-pressure areas of aeration system 100, for example at the interface of inlet 128 with support member 104 and vanes 114.

The fluid and the entrained, mixed and fragmented gas bubbles may then traverse support member 104, be accelerated by the rotation of vanes 114, and subsequently leave system 100 via an exit 130 disposed at the rear 118 of system 100. Exit 130 may have any desired cross-section, for example a frusto-conical cross-section with the narrower end proximate support member 104 and the wider end proximate rear 118.

Additional gas may be admitted to system 100 via at least one supplementary conduit 132. Supplementary conduit 132 may have a first end exposed to an gas source, for example ambient-pressure surface gas, and a second end in communication with at least one cavity 134 defined within housing 102. Cavity 134 may further be in communication with the interior of system 100. Low pressure areas created within the interior system 100, can create a venturi effect that may induce additional gas being directed through supplementary conduit 132 and cavity 134 due to the resulting pressure gradient.

Thus, the fluid, as well as the vortex-introduced gas, in addition to conduit-introduced gas and any other entrained gas streams can enter the device via inlet 128 and/or by means of a pressure differential between the pressure external to system 100 and the low pressure areas within system 100. The fluid with its entrained gas stream can then be expanded, fragmented, and directed towards rear 118 at an increased velocity, thereby producing an aerated stream containing bubbles and microbubbles. In some embodiments, this stream can be directed or vectored as a column of entrained bubbles and microbubbles extending from the rear 118 of system 100. This stream may be directed so as to reach desired areas of the surrounding fluid while displacing or transporting a volume of the surrounding fluid. Furthermore, system 100 may be utilized with sealed brushless electric motor components and equipped with hydroplaning or water-lubricated, abrasion resistant bearings, thereby allowing system 100 to operate while fully submerged in various fluids. Additionally, bore 122 can provide a passage for particulates and any other potential fouling agents, thereby allowing device 100 to be operable in fluids with high particulate concentrations or high chemical contamination for prolonged periods of time with reduced or no maintenance.

Figure 2A:
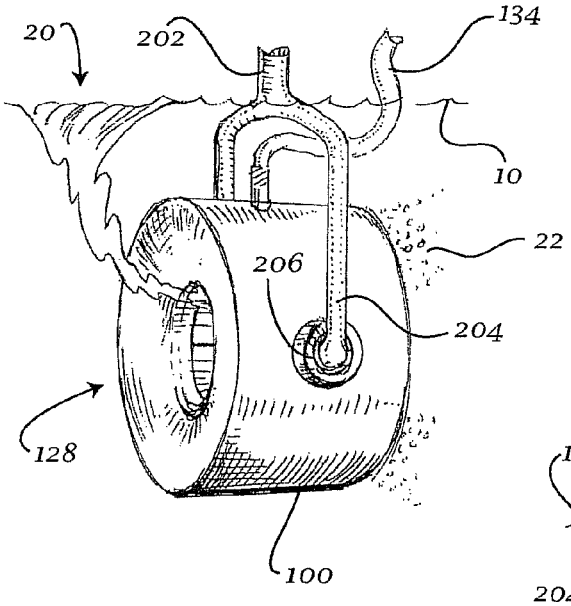
FIGS. 2A-2C show exemplary embodiments of an aeration system in operation.
Figure 2B:
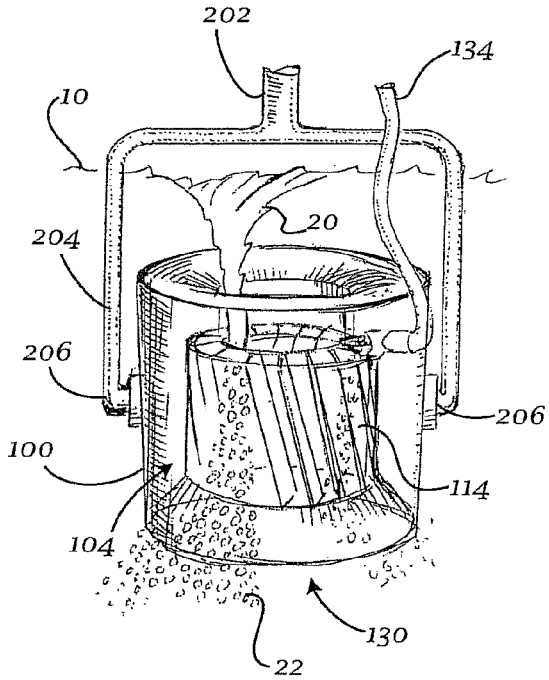

FIG. 2A shows an exemplary embodiment of system 100 submerged in a fluid 10 and disposed in a horizontal orientation. System 100 may be maintained within fluid 10 by a support structure, for example a bracket 202. Bracket 202 may have a first end coupled to an external structure and a bifurcated second end 204 which may be coupled to device 100. In the exemplary embodiment, bracket 202 may be rotatably coupled to device 100 via a pair of diametrically-opposed rotating joints 206, which can allow for the rotation of device 100 about an axis extending between the pair of rotating joints 206. FIG. 2B shows the exemplary embodiment of system 100 submerged in a fluid 10 and disposed in a vertical orientation, facilitated by rotation about the axis extending between rotating joints 206. Furthermore, as shown in FIGS. 2A and 2B, fluid 10, along with gas supplied via a vortex 20 may enter system 100 via inlet 128. Additional gas may enter system 100 via conduit 132. The fluid and gas stream can then be directed through support member 104 by the rotation of vanes 114, with the fluid being aerated by the gas while passing through support member 104. The resulting aerated bubble and microbubble stream 22 may then be directed via exit 130 away from system 100.

Figure 2C:
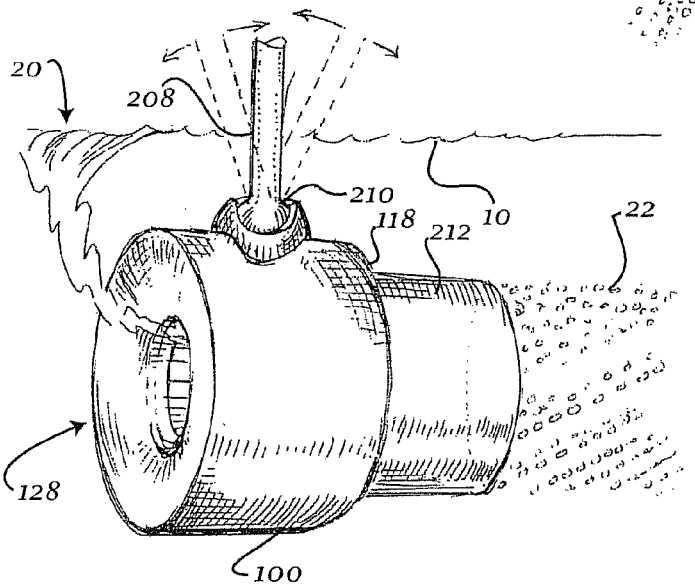

FIG. 2C shows an exemplary embodiment of system 100 supported within a fluid 10 by a support structure 208. Support structure 208 may be coupled to system 100 via a ball-and-socket joint 210, allowing system 100 to be pivoted and rotated as desired. A radial containment structure 212 may be coupled proximate rear 118 of system 100. The radial containment structure 212 may have a substantially tubular shape and may facilitate maintaining a columnar flow of stream 22 in a desired direction, as well as mitigating the spreading of stream 22.

The supports, such as bracket 202 and support structure 208, may be coupled to external structures such as structures fixed on land, floating platforms, or any other desired structure. Furthermore, supports 202, 208 may be adapted to have adjustable length so as to facilitate desired positioning of system 100 within the fluid medium.

Figure 2D:
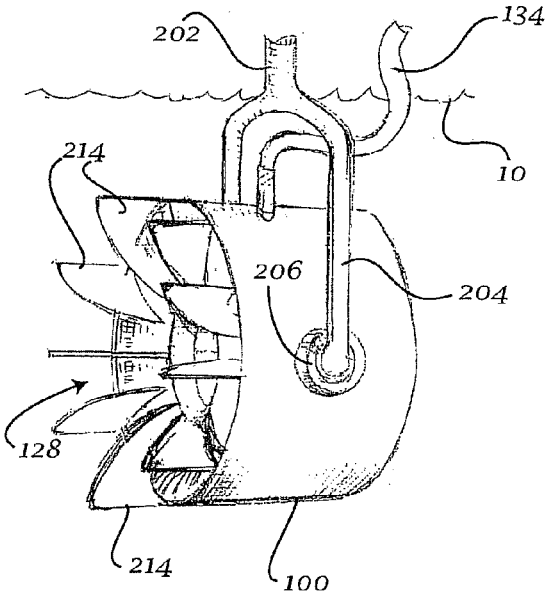
FIGS. 2D-2G show exemplary embodiments of an aeration system having inlet fins.
Figure 2E:
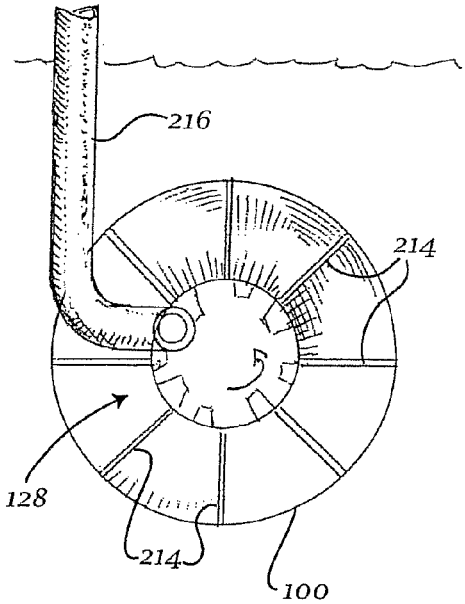
Figure 2F:
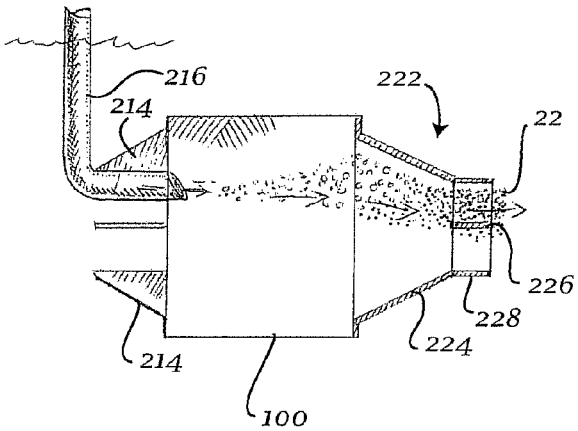
Figure 2G:
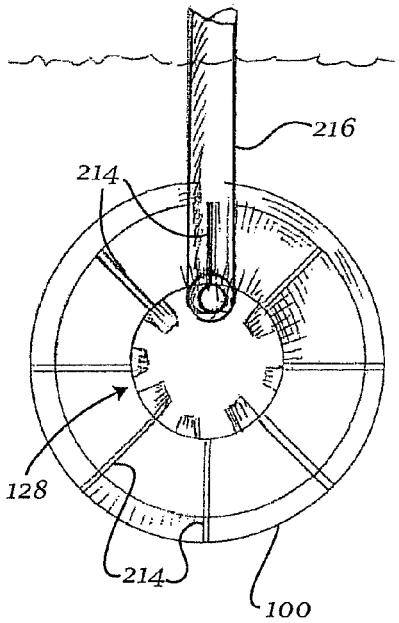
Figure 2H:
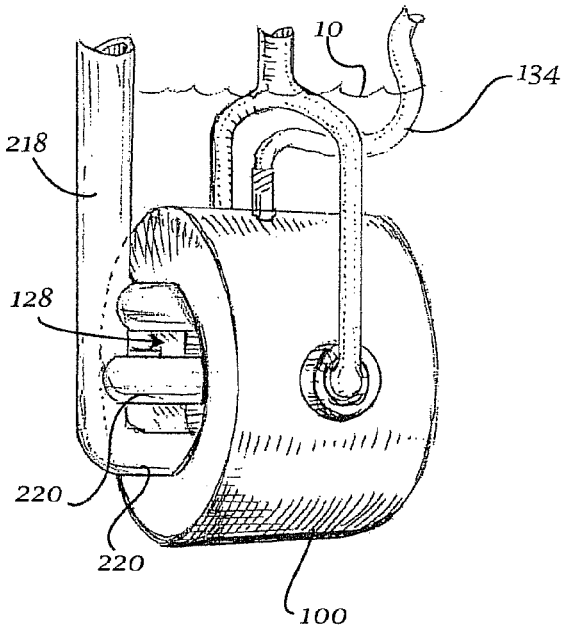
FIGS. 2H-2I show exemplary inlet manifolds for an aeration system.
Figure 2I:
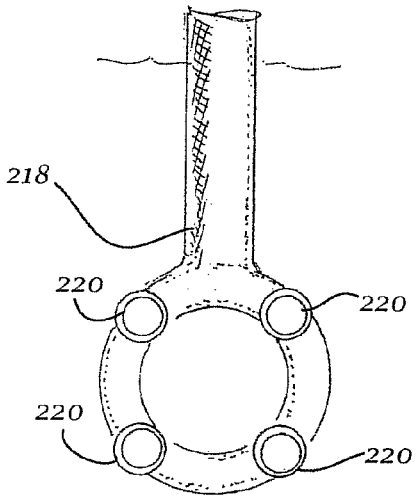

FIG. 2D shows an exemplary embodiment of system 100 including fins 214 disposed surrounding inlet 128. Fins 214 can minimize the rotation of fluid at inlet 128. Consequently, a primary gas conduit 216 may be provided to supply gas to inlet 128 of system 100 in lieu of vortex 20, as shown in FIG. 2E. Primary conduit 216 may be arranged in any desired manner, for example, disposed between fins 214. In other exemplary embodiments, primary conduit 216 may be coupled to one of the plurality fins 214, as shown in FIGS. 2F-2G. In yet other exemplary embodiments, a gas manifold 218 having a plurality of gas ports 220 may be disposed proximate inlet 128, as shown in FIGS. 2H-2I.

Figure 2J:
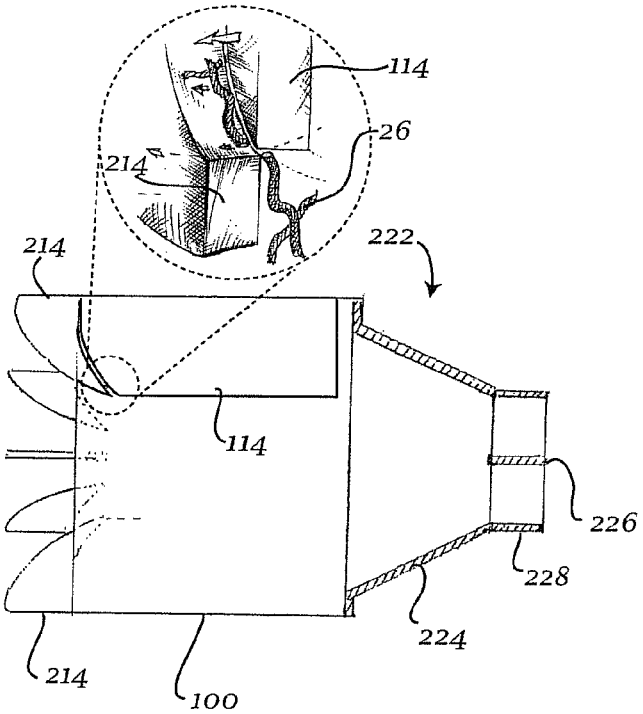
FIGS. 2J-2K show exemplary embodiments of an aeration system having flow directing structures.

Furthermore, in some exemplary embodiments, the clearance between the trailing edge of the fins 214 and the leading edge of vanes 114 may be minor. The small clearance between fins 214 and vanes 114 can facilitate clipping, cutting, or shearing off filamentous or other materials 26 that may be disposed in the fluid flow, when such materials pass through the clearance, as shown in FIG. 2J. Exemplary measurements for the clearance between fins 214 and vanes 114 may be in the range of about 1/64 inch or less.

Figure 2K:
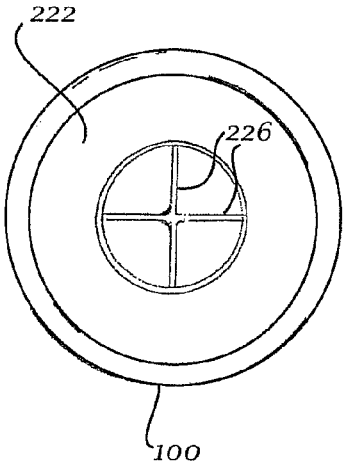
Figure 2L:
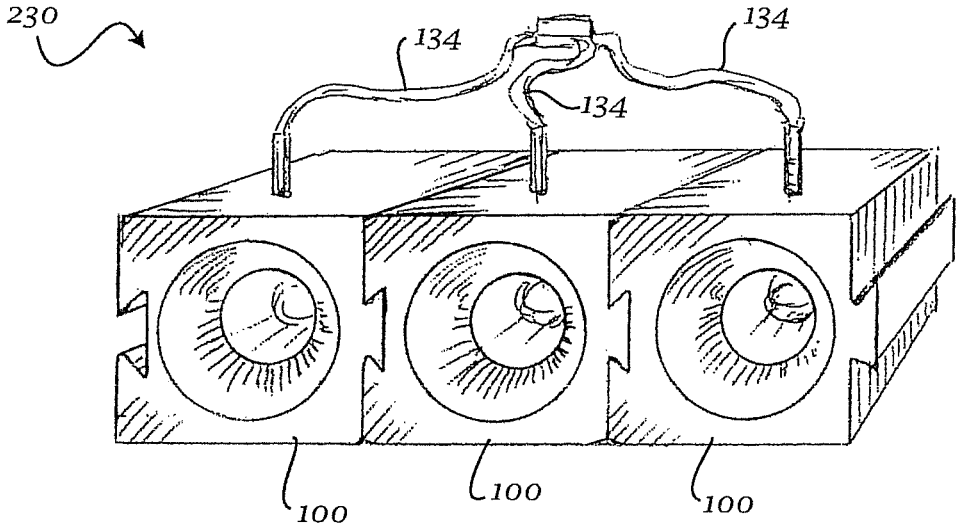
FIG. 2L shows an array of exemplary aeration systems.

In some exemplary embodiments, as shown in FIGS. 2G, and 2J-2K, a compression tube 222 may be coupled proximate end 118 of system 100. Compression tube 222 may have a frustoconical portion 224. The frustoconical portion 224 may taper towards a narrower diameter as it projects distally from end 118, thereby compressing the aerated stream 22, and facilitating a continuous travel of stream 22 as it is propelled away from system 100. A plurality of radial flow mitigation planes 226 may be disposed at the distal end of compression tube 222, for example within a tubular portion 228. Planes 226 may facilitate vectoring the flow of stream 22 rearward from system 100 and reducing the radial flow of stream 22 as well as reducing any swirling or spiraling currents within stream 22.

In some exemplary embodiments, multiple systems 100 may be arranged into an array 230. The systems 100 may be coupled to each other via any known coupling or fastening structure. In the exemplary embodiment shown in FIG. 2L, each system 100 may be coupled by a tongue-and-groove, or similar structure. Furthermore, in the exemplary embodiment shown in FIG. 2L, each system may be coupled by a rotatable structure capable of allowing variable axis of rotation or fluid flow in respect to adjacent systems.

Figure 2M:
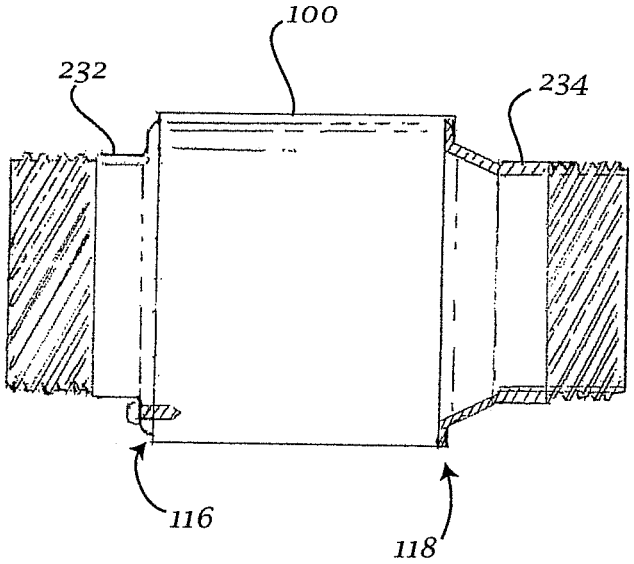
FIG. 2M shows an exemplary embodiment of an aeration system having inlet and outlet fittings.

FIG. 2M shows an exemplary embodiment of system 100 having a front fitting 232 coupled to the front 116 thereof, and a rear fitting 234 coupled to the rear 118 thereof. Fittings 232, 234 may be coupled to system 100 by any known coupling or fastening structures. Front and rear fittings 232, 234 can facilitate coupling system 100 to a fluid carrying conduit, such as a pipe or the like. To that end, fittings 232, 234 may include threaded flanges that may facilitate coupling the fittings to the fluid carrying conduit. Other structures for coupling fittings 232, 234 to a fluid carrying conduit may be contemplated and provided as desired. It should be appreciated that one or both fittings may be selected depending on the desired position of system 100 in relation to the fluid carrying conduit. As an illustrative example, fitting 232 may be used to couple system 100 to the tail of a pipe, fitting 234 may be used to couple system 100 to the head of a pipe, and both fittings 232, 234 may be used to couple system 100 between a pair of pipes.

Figure 3:
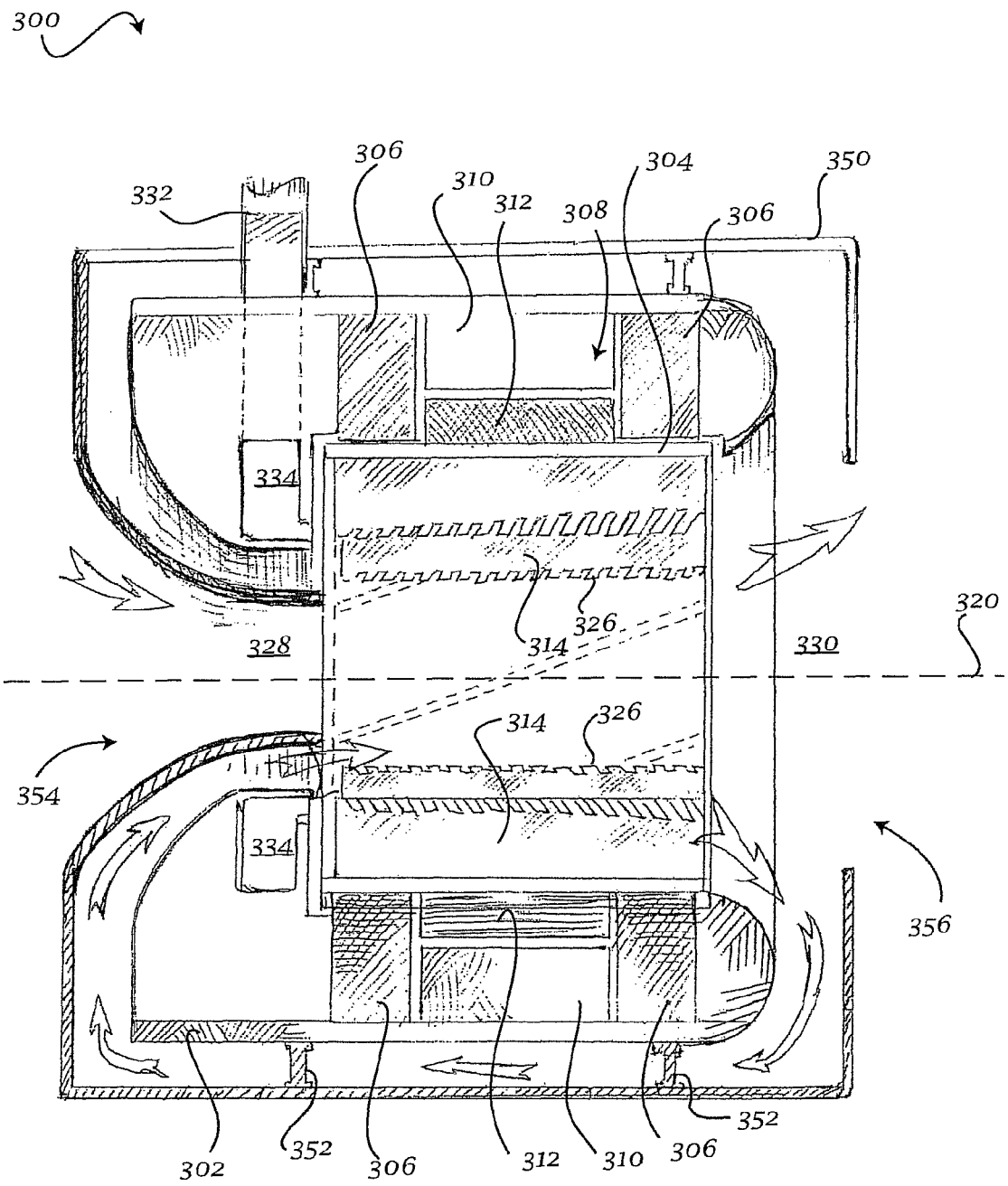
FIG. 3 is a longitudinal section view of an exemplary embodiment of an aeration system having a recirculating jacket.

FIG. 3 shows another exemplary embodiment of an aeration system 300. The embodiment of system 300 may include substantially similar components having substantially similar functionality to those disclosed in the embodiment of system 100 above. Such components are labeled by similar reference numerals with a leading digit of 3.

System 300 may include a jacket 350 surrounding housing 302. Jacket 350 may be coupled to housing 302 via a plurality of spacers 352, thereby defining a void between jacket 350 and housing 302. Spacers 352 can provide support and structural positioning to jacket 350. Jacket 350 may further include an inlet aperture 354. Inlet aperture 354 may have a shape substantially similar to the shape of inlet 328, and with a diameter lesser than that of inlet 328, thereby defining a void between inlet aperture 354 and inlet 328. Jacket 350 can further include an exit aperture 356, the exit aperture having a diameter lesser than that of exit 318. A portion of the aerated fluid stream 22 can thus be captured by jacket 350 and redirected through the void between jacket 350 and housing 302, and towards inlet 328. The recirculation of a portion of the fluid stream can facilitate creating a mixed-flow stream, thereby augmenting the homogeneity of the surrounding fluid. It should further be appreciated that the embodiment of system 300 may be adapted for use with any of the features shown in FIGS. 2*a*-2*m*, substantially as described above.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An aeration system, comprising:

a housing;

a fluid inlet disposed at a first end of the housing;

an outlet disposed at a second end of the housing;

a cylindrical support member rotatably mounted within the housing between the inlet and the outlet, and supported therein by a plurality of bearings, the support member having an interior surface enclosing an interior cavity, the interior cavity being in communication with the fluid inlet and the outlet;

at least one vane disposed on the interior surface of the support member and extending from the interior surface towards the rotational axis of the support member, the at least one vane including an inner edge positioned such that a gap is defined between the inner edge of the at least one vane and the rotational axis of the support member;

at least one gas inlet in communication with the interior cavity of the support member; and a motive device for rotating the support member within the housing; and a jacket surrounding the housing and positioned so as to define a gap between the jacket and housing, the jacket including an inlet aperture positioned proximate the fluid inlet and an outlet aperture positioned proximate the outlet;

the jacket being adapted to direct a portion of an aerated fluid stream exiting the outlet and redirect the portion of the aerated fluid stream towards the fluid inlet.

2. The aeration system of claim 1, wherein the inner edge of the at least one vane is serrated.

3. The aeration system of claim 1, wherein the fluid inlet functions as the at least one gas inlet.

4. The aeration system of claim 1, wherein the at least one gas inlet includes a manifold.

5. The aeration system of claim 1, further comprising:

a supplementary gas inlet; and a cavity defined in the housing; the cavity being in communication with the supplementary gas inlet and the interior cavity of the support member.

6. The aeration system of claim 1, further comprising a fluid directing structure coupled to the second end of the housing and in communication with the outlet.

7. The aeration system of claim 5, further comprising a plurality of plates disposed within a fluid directing structure.

8. The aeration system of claim 1, further comprising a plurality of fins coupled to the first end of the housing proximate the inlet.

9. The aeration system of claim 8, further comprising a clearance between an edge of the at least one vane and an edge of a fin.

10. An aeration system, comprising:

a cylindrical support member rotatably mounted within a housing, and supported therein by a plurality of bearings, the support member having an interior surface enclosing an interior cavity, the interior cavity being in communication with a fluid inlet disposed at a first end of the housing and an outlet disposed at a second end of the housing;

a plurality of vanes disposed on the interior surface of the support member and extending from the interior surface towards the rotational axis of the support member, each vane including an inner edge;

a bore defined by the inner edges of the plurality of vanes, the bore extending longitudinally through the support member and disposed concentrically with the rotational axis of the support member; and a motive device for rotating the support member within the housing; and a jacket surrounding the housing and positioned so as to define a gap between the jacket and housing, the jacket including an inlet aperture positioned proximate the fluid inlet and an outlet aperture positioned proximate the outlet;

the jacket being adapted to direct a portion of an aerated fluid stream exiting the outlet and redirect the portion of the aerated fluid stream towards the fluid inlet.

11. The aeration system of claim 10, wherein the inner edge of the at least one vane is serrated.

12. The aeration system of claim 10, wherein the fluid inlet functions as at least one gas inlet.

13. The aeration system of claim 10, wherein at least one gas inlet includes a manifold.

14. The aeration system of claim 10, further comprising:

a supplementary gas inlet; and a cavity defined in the housing; the cavity being in communication with the supplementary gas inlet and the interior cavity of the support member.

15. The aeration system of claim 10, further comprising a fluid directing structure coupled to the second end of the housing and in communication with the outlet.

16. The aeration system of claim 15, further comprising a plurality of plates disposed within the fluid directing structure.

17. The aeration system of claim 10, further comprising a plurality of fins coupled to the first end of the housing proximate the inlet.

18. The aeration system of claim 17, further comprising a clearance between an edge of the at least one vane and an edge of a fin.

* * * * *